US009942957B1

(12) United States Patent
Lin et al.

(10) Patent No.: US 9,942,957 B1
(45) Date of Patent: Apr. 10, 2018

(54) LIGHT EMITTING DIODE DRIVING CIRCUIT

(71) Applicant: EDISON OPTO (DONGGUAN) CO., LTD., Dongguan, Guang Dong (CN)

(72) Inventors: Yu-Chen Lin, Dongguan (CN); Tsung-Heng Lin, Dongguan (CN); Jin-Ping Liu, Dongguan (CN)

(73) Assignee: EDISON OPTO (DONGGUAN) CO., LTD., Dongguan, Guang Dong (CN)

( * ) Notice: Subject to any disclaimer, the term of this patent is extended or adjusted under 35 U.S.C. 154(b) by 0 days.

(21) Appl. No.: 15/473,639

(22) Filed: Mar. 30, 2017

(30) Foreign Application Priority Data

Oct. 12, 2016 (CN) ..... 2016 1 0890639

(51) Int. Cl.
*H05B 33/08* (2006.01)

(52) U.S. Cl.
CPC ..... *H05B 33/0824* (2013.01); *H05B 33/083* (2013.01); *H05B 33/0815* (2013.01); *H05B 33/0827* (2013.01); *H05B 33/0845* (2013.01); *H05B 33/089* (2013.01); *H05B 33/0884* (2013.01)

(58) Field of Classification Search
CPC ..... H05B 33/083; H05B 33/0887; H05B 33/0806; H05B 37/02; H05B 33/0824; H05B 33/0827; H05B 33/089; H05B 33/0884
See application file for complete search history.

(56) References Cited

U.S. PATENT DOCUMENTS 8,207,685 B2 * 6/2012 Cheng ..... H05B 33/0824 315/185 R
8,766,550 B1 * 7/2014 Yoon ..... H05B 33/083 315/200 R
9,468,058 B2 * 10/2016 Kang ..... H05B 33/083
2011/0273099 A1 11/2011 Liang
2012/0256550 A1 * 10/2012 Akiyama ..... H05B 33/0809 315/187
2013/0015773 A1 1/2013 Tai
2013/0076247 A1 * 3/2013 Chung ..... H05B 33/0824 315/122
2013/0200812 A1 * 8/2013 Radermacher ..... H05B 33/0824 315/186

(Continued)

*Primary Examiner* — Kretelia Graham
*Assistant Examiner* — Borna Alaeddini
(74) *Attorney, Agent, or Firm* — Winston Hsu

(57) ABSTRACT

A light emitting diode driving circuit is provided for driving a first LED unit and a second LED unit. The light emitting diode driving circuit includes a power supply, a detection unit, a serial-parallel circuit, and a control unit. The serial-parallel circuit is coupled to the first LED unit and the second LED unit and establishes a serial connection or a parallel connection for the first LED unit and the second LED unit. The detection unit is coupled to an output end of the power supply for generating a corresponding detection signal according to an output voltage of the power supply. The control unit is arranged between the detection unit and the serial-parallel circuit. The control unit determines the first LED unit and the second LED unit to be set up in the serial connection or in the parallel connection according to the corresponding detection signal.

9 Claims, 2 Drawing Sheets

(56) References Cited

U.S. PATENT DOCUMENTS

| | | | | |
|---|---|---|---|---|
| 2015/0091455 | A1* | 4/2015 | Yu | H05B 33/0824 315/193 |
| 2015/0163869 | A1* | 6/2015 | Yu | H05B 33/0806 315/191 |
| 2016/0037596 | A1* | 2/2016 | Chen | H05B 33/0812 315/122 |
| 2016/0050730 | A1* | 2/2016 | Kim | H05B 33/0812 315/191 |
| 2016/0255691 | A1* | 9/2016 | Yu | H05B 33/0824 315/193 |
| 2016/0360586 | A1* | 12/2016 | Yang | H05B 33/0815 |
| 2017/0048947 | A1* | 2/2017 | Kim | H05B 33/083 |

* cited by examiner

LIGHT EMITTING DIODE DRIVING CIRCUIT

BACKGROUND OF THE INVENTION

1. Field of the Invention

The invention relates to a driving circuit, and more particularly, to a light emitting diode driving circuit.

2. Description of the Prior Art

Environmental protection policies to save energy and cut down on the production of $CO_2$ have been put to practice by countries around the world in light of the rising of environmental protecting awareness in recent years. One of the policies is to try to reduce the power consumed by lighting. Light emitting diode (LED) lighting is hence the star in power-saving lighting market, since LED lighting is power-saving, environmental friendly, having long life, and robust, and is increasingly replacing traditional lighting and expanding its applications in other fields.

The voltage of alternative current (AC) power provided in the market usually comes with 120V or 240V. If the driving circuit of LED is designed to be driven by 120V driving voltage, it cannot be implemented under the 240V AC power since such high voltage provision causes the LED to degrade or fail. Hence, the amount of LEDs to be coupled serially to the load should be prepared in advance in view of what voltage the AC power is, 120V or 240V. In other words, it is inconvenient to have to settle the specification of external power source before determining the amount of serially connected LEDs.

There is therefore a need to renovate the conventional LED driving circuit.

SUMMARY OF THE INVENTION

To solve the above-mentioned problem, embodiments of the invention provide a full voltage range LED driving circuit adapted both for alternative power source having a first voltage peak and for alternative power source having a second voltage peak and need not adjusting the amount of load LEDs in serial connection.

An embodiment of the invention provides a light emitting diode driving circuit for driving a first LED unit and a second LED unit. The light emitting diode driving circuit includes a power supply, a serial-parallel circuit, a detection unit, and a control unit. The serial-parallel circuit is coupled to the first LED unit and the second LED unit and establishes a serial connection for the first LED unit and the second LED unit or a parallel connection for the first LED unit and the second LED unit. The serial-parallel circuit includes a first switch circuit, a second switch circuit, and a connecting circuit. The first switch circuit is arranged between an output end of the power supply and the first LED unit. The second switch circuit is arranged between the second LED unit and a ground voltage. The connecting circuit is coupled to the first switch circuit and the second switch circuit. The first LED unit and the second LED unit are in serial connection via the connecting circuit when the first switch circuit and the second switch circuit are off. The first LED unit and the second LED unit are in parallel connection via the connecting circuit when the first switch circuit and the second switch circuit turn on. The detection unit is coupled to the output end of the power supply for generating a corresponding detection signal according to an output voltage of the power supply. The control unit is arranged between the detection unit and the serial-parallel circuit. The control unit determines the first LED unit and the second LED unit to be setup in the serial connection or in the parallel connection according to the corresponding detection signal.

The embodiments of the invention implement a configuration such that when the power supply provides a first voltage, e.g. 240V, the first LED unit and the second LED unit form a serial connection structure so as to increase the amount of LEDs serially coupled to the load, and when the power supply provides a second voltage, e.g. 120V, the first LED unit and the second LED unit form a parallel connection structure so as to decrease the amount of LEDs serially coupled to the load. With the configuration of the invention, both the first LED unit and the second LED unit work under proper operating voltage and can be kept from degradation or failure.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
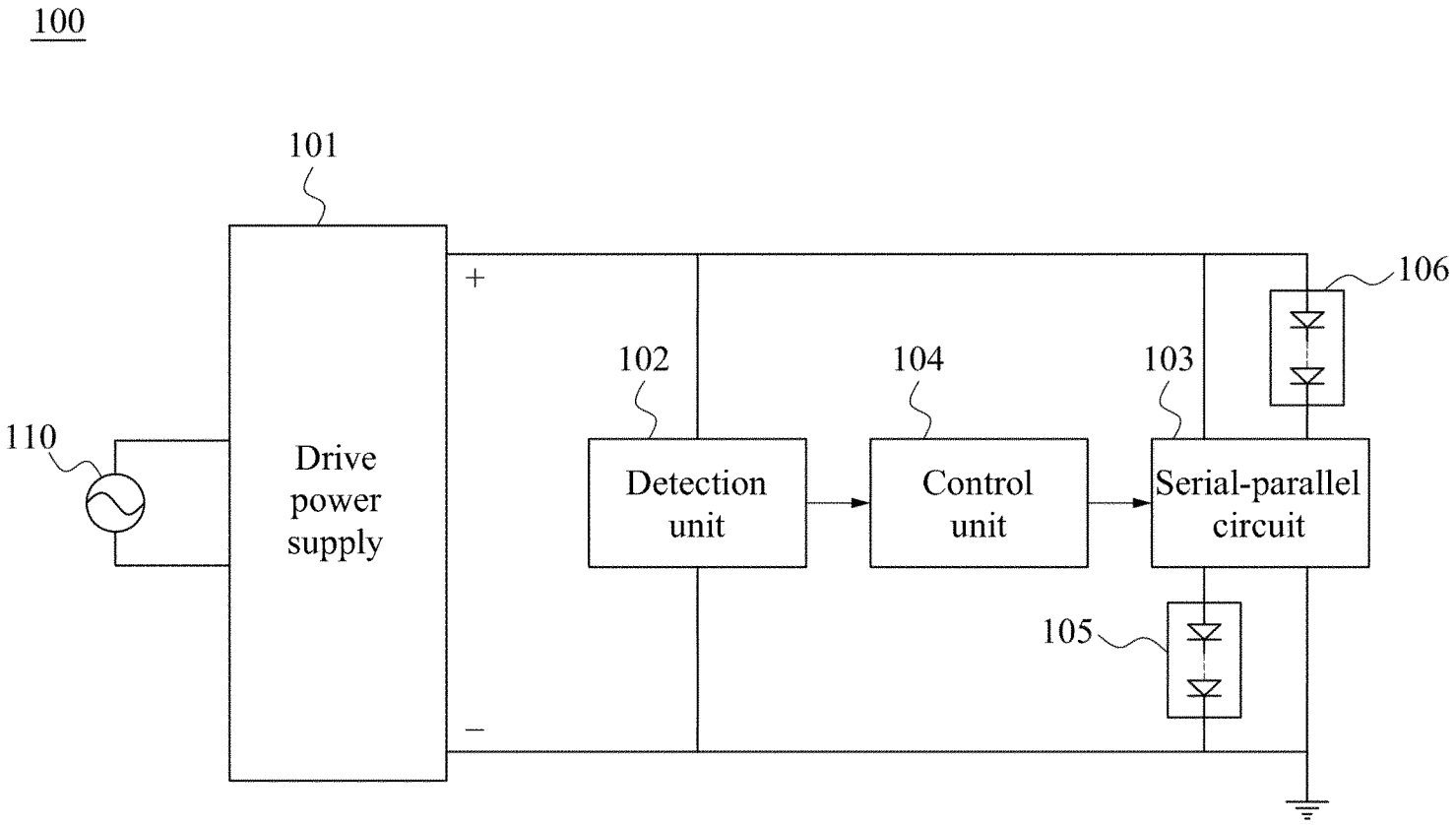
FIG. 1 is a schematic diagram showing a light emitting diode (LED) driving circuit according to an embodiment of the invention.

Please refer to FIG. 1, which is a schematic diagram showing a light emitting diode (LED) driving circuit according to an embodiment of the invention. As shown in FIG. 1, the LED driving circuit 100 drives a first LED unit 105 and a second LED unit 106 to emit lights. The LED driving circuit 100 includes a power supply 101, a detection unit 102, a serial-parallel circuit 103, and a control unit 104. In an embodiment, the first LED unit 105 and the second LED unit 106 can each include a plurality of serially connected light emitting diodes. One end of the first LED unit 105 is coupled to the power supply 101 via the serial-parallel circuit 103 and the other end grounded. One end of the second LED unit 106 is coupled to the power supply 101 and the other end grounded via the serial-parallel circuit 103.

The power supply 101 is a rectifying circuit having an input end and an output end. The input end of the power supply 101 is coupled to an AC power 110. The AC power 110 is rectified to be a DC power output provided by the output end. The detection unit 102 is coupled to the output end of the power supply 101 for generating a corresponding detection signal according to the output voltage of the power supply 101. The serial-parallel circuit 103 is coupled to the first LED unit 105 and the second LED unit 106 to establish a serial connection for the first LED unit 105 and the second LED unit 106 or a parallel connection for the first LED unit 105 and the second LED unit 106. In an embodiment, the first LED unit 105 has its positive end coupled to the serial-parallel circuit 103 and negative end coupled to the negative electrode of the output end of the power supply 101. The second LED unit 106 has its positive end coupled to the positive electrode of the output end of the power supply 101 and negative end coupled to the serial-parallel circuit 103. The control unit 104 is arranged between the detection unit 102 and the serial-parallel circuit 103 for receiving the corresponding detection signal generated by the detection unit 102 according to the outputted DC voltage from the power supply 101 and controlling the serial-parallel circuit 103 so that the first LED unit 105 and the second LED unit 106 can be set up in the serial connection or in the parallel connection.

In an embodiment, when the power supply 101 provides a first DC voltage with 240V, which will be detected by the detection unit 102 and a first detection signal is generated accordingly for the control unit 104. The control unit 104 then controls the serial-parallel circuit 103 based on the first detection signal so that the first LED unit 105 and the second LED unit 106 can be set up in the serial connection; hence increasing the amount of LEDs serially coupled to the power supply 101 and the LEDs illuminating with the first DC voltage provided by the power supply 101. On the other hands, when the power supply 101 provides a second DC voltage with 120V, which will be detected by the detection unit 102 and a second detection signal is generated accordingly for the control unit 104. The control unit 104 then controls the serial-parallel circuit 103 based on the second detection signal so that the first LED unit 105 and the second LED unit 106 can be setup in the parallel connection; hence decreasing the amount of LEDs serially coupled to the power supply 101 and the LEDs illuminating with the second DC voltage provided by the power supply 101. By doing so, the driving circuit provided in the embodiment of the invention is adaptive for AC power with different voltages and both the first LED unit 105 and the second LED unit 106 are operable under proper voltage without the need of adjusting the amount of the first LED unit 105 and the second LED unit 106.

Figure 2:
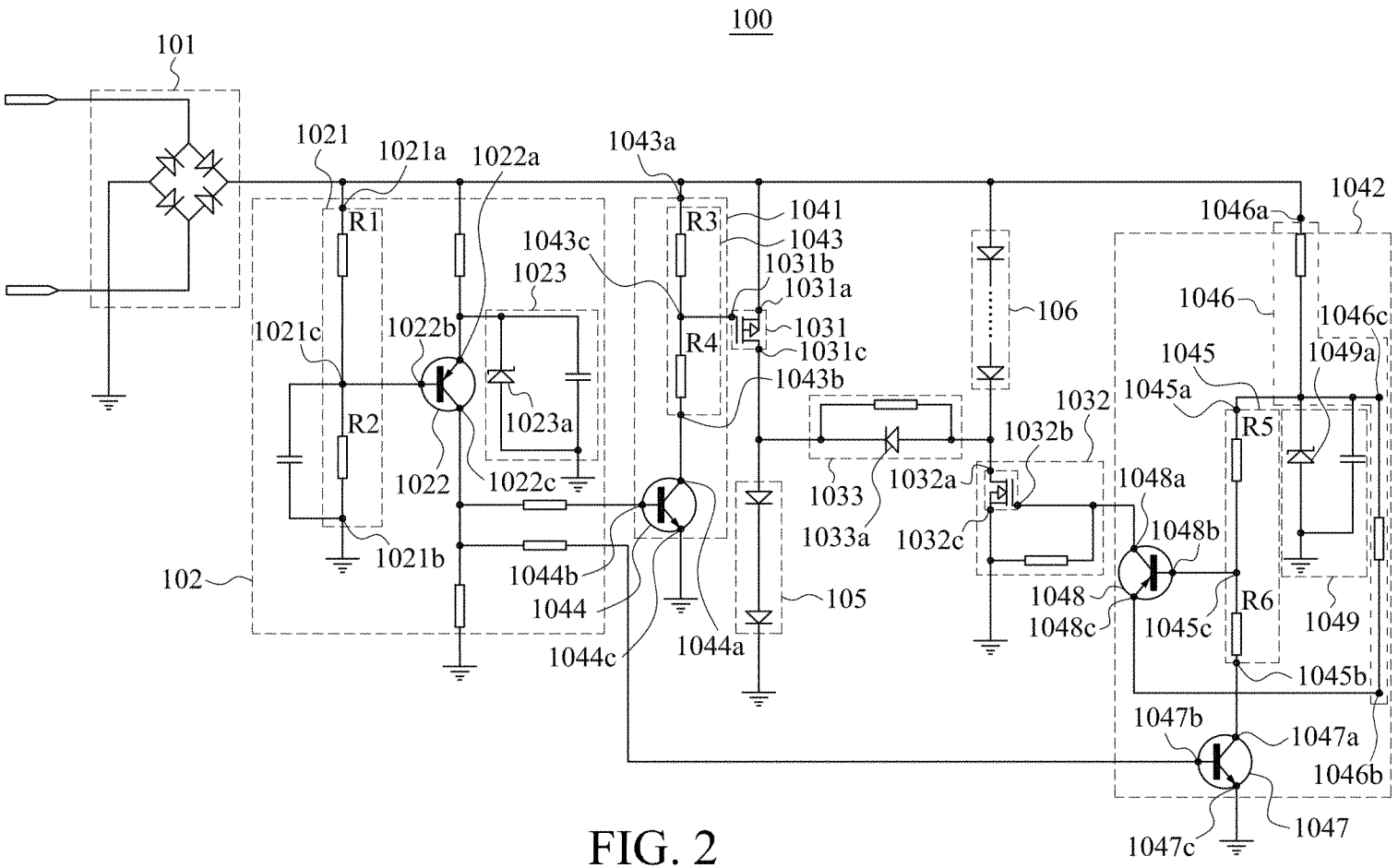
FIG. 2 is a schematic diagram showing details of a light emitting diode (LED) driving circuit according to an embodiment of the invention.

FIG. 2 is a schematic diagram showing details of a light emitting diode (LED) driving circuit according to an embodiment of the invention. The detection unit 102 further includes a first voltage-dividing circuit 1021, a first transistor switch 1022, and a first regulator unit 1022. The first voltage-dividing circuit 1021 further includes a first end 1021*a*, a second end 1021*b*, and a connecting end 1021*c*, i.e., the voltage-dividing end. The first end 1021*a* of the first voltage-dividing circuit 1021 is coupled to the positive electrode of the output end of the power supply 101 and the second end 1021*b* of the first voltage-dividing circuit 1021 is coupled to the ground voltage. The first voltage-dividing circuit 1021 generates a first division voltage at the connecting end 1021*c* and provides for the first transistor switch 1022 according to voltage of the output end of the power supply 101, to turn on or off the first transistor switch 1022. The first transistor switch 1022 includes a first end 1022*a*, a second end 1022*b*, and, and a third end 1022*c*. The first end 1022*a* of the first transistor switch 1022 is coupled to the positive electrode of the output end of the power supply 101, the second end 1022*b* of the first transistor switch 1022 is coupled to the connecting end 1021*c* of the first voltage-dividing circuit 1021, and the third end 1022*c* of the first transistor switch 1022 is coupled to the control unit 104. The first regulator unit 1023 is coupled to the first end 1022*a* of the first transistor switch 1022 to provide a first regulatory voltage at the first end 1022*a* of the first transistor switch 1022.

In an embodiment, the first transistor switch 1022 is a PNP-type bipolar junction transistor (BJT) and the first regulator unit 1023 further includes a first Zener diode 1023*a*, wherein the anode of the first Zener diode 1023*a* is coupled to the ground voltage and the cathode of the first Zener diode 1023*a* is coupled to the first end 1022*a* of the first transistor switch 1022 for providing the fixed-value first regulatory voltage at the first end 1022*a* of the first transistor switch 1022. The first voltage-dividing circuit 1021 includes two voltage-dividing resistances R1, R2 serially coupled to the connecting end 1021*c*, which is further coupled to the second end 1022*b* of the first transistor switch 1022. Since the first end 1021*a* and the second end 1021*b* of the two voltage-dividing resistances R1, R2 are respectively coupled to the positive electrode of the output end of the power supply 101 and the ground voltage, the first division voltage that corresponds to the positive electrode of the output end of the power supply 101 can be generated at the connecting end 1021*c* and provided to the second end 1022*b* of the first transistor switch 1022. The first division voltage cooperates with the first regulatory voltage provided by the first regulator unit 1023 at the first end 1022*a* of the first transistor switch 1022 and controls the turning on or off of the first transistor switch 1022, so that the corresponding detection signal may be generated at the third end 1022*c* of the first transistor switch 1022. Accordingly, when the power supply 101 provides a first DC voltage with 240V, the two voltage-dividing resistances R1, R2 of the first voltage-dividing circuit 1021 generate the first division voltage with a first voltage value at the connecting end 1021*c*, which is provided to the second end 1022*b* of the first transistor switch 1022. By implementing the two voltage-dividing resistances R1, R2, the first voltage value can be determined to be greater than the fixed-value first regulatory voltage provided by the first regulator unit 1023 at the first end 1022*a* of the first transistor switch 1022, and since the first transistor switch 1022 is a PNP-type bipolar junction transistor (BJT), the first transistor switch 1022 will be turned off accordingly, which generates the first detection signal corresponding to the ground voltage for the control unit 104 at the third end 1022*c* of the first transistor switch 1022. On the other hand, when the power supply 101 provides a second DC voltage with 120V, the two voltage-dividing resistances R1, R2 of the first voltage-dividing circuit 1021 generate the first division voltage with a second voltage value at the connecting end 1021*c*, which is provided to the second end 1022*b* of the first transistor switch 1022. The second voltage value can be determined to be smaller than the fixed-value first regulatory voltage provided by the first regulator unit 1023 at the first end 1022*a* of the first transistor switch 1022, and since the first transistor switch 1022 is a PNP-type bipolar junction transistor (BJT), the first transistor switch 1022 will be turned on accordingly, which generates the second detection signal corresponding to the positive electrode of the output end of the power supply 101 for the control unit 104 at the third end 1022*c* of the first transistor switch 1022.

The serial-parallel circuit 103 includes a first switch circuit 1031, a second switch circuit 1032, and a connecting circuit 1033. The first switch circuit 1031 includes a first end 1031*a*, a second end 1031*b*, and a third end 1031*c*. The first end 1031*a* of the first switch circuit 1031 is coupled to the positive electrode of the output end of the power supply 101, the second end 1031*b* of the first switch circuit 1031 is coupled to the control unit 104, and the third end 1031*c* of the first switch circuit 1031 is coupled to the first LED unit 105. In an embodiment, the first switch circuit 1031 is a P-type MOSFET. Additionally, the second switch circuit 1032 also includes a first end 1032*a*, a second end 1032*b*, and a third end 1032*c*. The first end 1032*a* of the second switch circuit 1032 is coupled to the second LED unit 106, the second end 1032*b* of the second switch circuit 1032 is coupled to the control unit 104, and the third end 1032*c* of the second switch circuit 1032 is coupled to the second end

1032*b* and further coupled to the ground voltage. In one embodiment, the second switch circuit 1032 can be an N-type MOSFET. On the other hand, the connecting circuit 1033 is coupled to the third end 1031*c* of the first switch circuit 1031 and the first end 1032*a* of the second switch circuit 1032. Hence, when the first switch circuit 1031 and the second switch circuit 1032 are off, the first LED unit 105 and the second LED unit 106 form a serial connection via the connecting circuit 1033. When the first switch circuit 1031 and the second switch circuit 1032 turn on, the first LED unit 105 and the second LED unit 106 form a parallel connection. The first LED unit 105 is coupled to the positive electrode of the output end of the power supply 101 via the first switch circuit 1031 that is turned on, placing the first LED unit 105 between the positive electrode of the output end of the power supply 101 and the ground voltage. The second LED unit 106 is coupled to the ground voltage via the second switch circuit 1032 that is turned on, placing the second LED unit 106 between the positive electrode of the output end of the power supply 101 and the ground voltage. In one embodiment, the connecting circuit 1033 further includes a diode 1033*a*, whose anode being coupled to the first end 1032*a* of the second switch circuit 1032 and cathode being coupled to the third end 1031*c* of the first switch circuit 1031.

To turn on or off the first switch circuit 1031 and the second switch circuit 1032 of the serial-parallel circuit 103 according to the detection signal of the detection unit 102, the control unit 104 further uses a first control circuit 1041 and a second control circuit 1042 respectively disposed between the detection unit 102 and the first switch circuit 1031 and between the detection unit 102 and the second switch circuit 1032. The first control circuit 1041 is disposed between the third end 1022*c* of the first transistor switch 1022 of the detection unit 102 and the second end 1031*b* of the first switch circuit 1031 to control the turning on or off of the first switch circuit 1031 according to the detection signal generated at the third end 1022*c* of the first transistor switch 1022. The second control circuit 1042 is disposed between the third end 1022*c* of the first transistor switch 1022 of the detection unit 102 and the second end 1032*b* of the second switch circuit 1032 to control the turning on or off of the second switch circuit 1032 according to the detection signal generated at the third end 1022*c* of the first transistor switch 1022. In one embodiment, the first control circuit 1041 further includes a second voltage-dividing circuit 1043 and a second transistor switch 1044. The second voltage-dividing circuit 1043 includes a first end 1043*a*, a second end 1043*b*, and a connecting end 1043*c*, i.e., the voltage-dividing end. The first end 1043*a* of the second voltage-dividing circuit 1043 is coupled to the positive electrode of the output end of the power supply 101 for generating the second division voltage at the connecting end 1043*c* according to the output voltage of the power supply 101 and providing the second division voltage for the second end 1031*b* of the first switch circuit 1031 of the serial-parallel circuit 103. The second transistor switch 1044 includes a first end 1044*a*, a second end 1044*b*, and a third end 1044*c*. The first end 1044*a* of the second transistor switch 1044 is coupled to the second end 1043*b* of the second voltage-dividing circuit 1043, the second end 1044*b* of the second transistor switch 1044 is coupled to the third end 1022*c* of the first transistor switch 1022 of the detection unit 102, and the third end 1044*c* of the second transistor switch 1044 is coupled to the ground voltage. The second voltage-dividing circuit 1043 includes two voltage-dividing resistances R3, R4 serially coupled to the connecting end 1043*c*, which is coupled to the second end 1031*b* of the first switch circuit 1031. Since the first end 1043*a* and the second end 1043*b* of the second voltage-dividing circuit 1043 are respectively coupled to the positive electrode of the output end of the power supply 101 and the second transistor switch 1044, the second division voltage with different voltages can be generated at the connecting end 1043*c* according to the on/off status of the second transistor switch 1044 to control the turning on or off of the first switch circuit 1031.

The second control circuit 1042 includes a third voltage-dividing circuit 1045, a fourth voltage-dividing circuit 1046, a third transistor switch 1047, a fourth transistor switch 1048, and a second regulator unit 1049. The third voltage-dividing circuit 1045 includes a first end 1045*a*, a second end 1045*b*, and a connecting end 1045*c*, i.e., the voltage-dividing end. The fourth voltage-dividing circuit 1046 includes a first end 1046*a*, a second end 1046*b*, and a connecting end 1046*c*, i.e., the voltage-dividing end. The third transistor switch 1047 includes a first end 1047*a*, a second end 1047*b*, and a third end 1047*c*. The first end 1047*a* of the third transistor switch 1047 is coupled to the second end 1045*b* of the third voltage-dividing circuit 1045, the second end 1047*b* of the third transistor switch 1047 is coupled to the third end 1022*c* of the first transistor switch 1022 of the detection unit 102, and the third end 1047*c* of the third transistor switch 1047 is coupled to the ground voltage. The fourth transistor switch 1048 includes a first end 1048*a*, a second end 1048*b*, and a third end 1048*c*. The first end 1048*a* of the fourth transistor switch 1048 is coupled to the second end 1032*b* of the second switch circuit 1032 and the second end 1048*b* of the fourth transistor switch 1048 is coupled to the connecting end 1045*c* of the third voltage-dividing circuit 1045. The second regulator unit 1049 is coupled to the first end 1045*a* of the third voltage-dividing circuit 1045 and the connecting end 1046*c* of the fourth voltage-dividing circuit 1046, to provide a second regulatory voltage at the first end 1045*a* of the third voltage-dividing circuit 1045 and at the connecting end 1046*c* of the fourth voltage-dividing circuit 1046. In one embodiment, the second regulator unit 1049 further includes a second Zener diode 1049*a*, whose anode being coupled to the ground voltage and cathode being coupled to the first end 1045*a* of the third voltage-dividing circuit 1045 and the connecting end 1046*c* of the fourth voltage-dividing circuit 1046. The second regulator unit 1049 is capable of providing a fixed-value second regulatory voltage at the first end 1045*a* of the third voltage-dividing circuit 1045. The third voltage-dividing circuit 1045 includes two voltage-dividing resistances R5, R6 serially coupled to the connecting end 1045*c*, which is coupled to the second end 1048*b* of the fourth transistor switch 1048. Hence, the fixed-value second regulatory voltage provided by the second regulator unit 1049 generates a third division voltage with different voltages at the connecting end 1045*c* according to the on/off status of the third transistor switch 1047 to control the turning on or off of the fourth transistor switch 1048.

In an embodiment, since the second transistor switch 1044 is an NPN-type bipolar junction transistor (BJT) and the first switch circuit 1031 is a P-type MOSFET, when the first transistor switch 1022 is turned off due to the 240V first DC voltage provided by the power supply 101 and a low level first detection signal corresponding to the ground voltage is generated at the third end 1022*c* of the first transistor switch 1022, the first detection signal leads to the second transistor switch 1044 being turned off, and a high level second division voltage corresponding to the positive electrode of the output end of the power supply 101 is generated at the connecting end 1043*c* of the second voltage-dividing circuit 1043 to turn off the first switch circuit 1031. On the other hand, since the second switch circuit 1032 is an N-type MOSFET, the third transistor switch 1047 is an NPN-type bipolar junction transistor (BJT), and the fourth transistor switch 1048 is a PNP-type bipolar junction transistor (BJT), the first detection signal also turns off the third transistor switch 1047, which generates responsively a high level third division voltage corresponding to the positive electrode of the output end of the power supply 101 at the connecting end 1045*c* of the third voltage-dividing circuit 1045 to turn off the fourth transistor switch 1048. Given that the third end 1032*c* of the second switch circuit 1032 is coupled to the second end 1032*b* and to the ground voltage, the second switch circuit 1032 is also turned off as a result. With both the first switch circuit 1031 and the second switch circuit 1032 turned off, the first LED unit 105 and the second LED unit 106 therefore form a serial connection via the connecting circuit 1033 when receiving the 240V voltage from the power supply 101.

On the other hand, when the first transistor switch 1022 is turned on due to the 120V second DC voltage provided by the power supply 101 and a high level second detection signal corresponding to the positive electrode of the output end of the power supply 101 is generated at the third end 1022*c* of the first transistor switch 1022, the second detection signal leads to the second transistor switch 1044 being turned on, and a low level voltage corresponding to the positive electrode of the output end of the power supply 101 is generated at the connecting end 1043*c* of the second voltage-dividing circuit 1043 to turn on the first switch circuit 1031. On the other hand, the high level second detection signal also turns on the third transistor switch 1047, which generates responsively a third division voltage corresponding to the ground voltage at the connecting end 1045*c* of the third voltage-dividing circuit 1045 to turn on the fourth transistor switch 1048. The power supply 101 then controls the second switch circuit 1032 being turned on via the fourth voltage-dividing circuit 1046. With both the first switch circuit 1031 and the second switch circuit 1032 turned on, the first LED unit 105 and the second LED unit 106 therefore form a parallel connection when respectively receiving the 120V voltage from the power supply 101.

In summary, the embodiments of the invention implement a configuration such that when the power supply provides a first voltage, e.g. 240V, the first LED unit and the second LED unit form a serial connection structure so as to increase the amount of LEDs serially coupled to the load, and when the power supply provides a second voltage, e.g. 120V, the first LED unit and the second LED unit form a parallel connection structure so as to decrease the amount of LEDs serially coupled to the load. With the configuration of the invention, both the first LED unit and the second LED unit work under proper operating voltage and can be kept from degradation or failure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light emitting diode driving circuit, comprising:

a power supply for driving a first LED unit and a second LED unit;

a serial-parallel circuit coupled to the first LED unit and the second LED unit and establishing a serial connection for the first LED unit and the second LED unit or a parallel connection for the first LED unit and the second LED unit, the serial-parallel circuit comprising:

a first switch circuit arranged between an output end of the power supply and the first LED unit;

a second switch circuit arranged between the second LED unit and a ground voltage; and a connecting circuit coupled to the first switch circuit and the second switch circuit; wherein the first LED unit and the second LED unit are in serial connection via the connecting circuit when the first switch circuit and the second switch circuit are off; wherein the first LED unit and the second LED unit are in parallel connection via the connecting circuit when the first switch circuit and the second switch circuit turn on;

a detection unit coupled to the output end of the power supply for generating a corresponding detection signal according to an output voltage of the power supply, the detection unit comprising:

a first voltage-dividing circuit comprising a first end, a second end, and a voltage-dividing end, the first end of the first voltage-dividing circuit coupled to the output end of the power supply, the second end of the first voltage-dividing circuit coupled to the ground voltage, the first voltage-dividing circuit generating a first division voltage at the voltage-dividing end of the first voltage-dividing circuit according to the output voltage of the power supply;

a first transistor switch comprising a first end, a second end, and a third end, wherein the first end of the first transistor switch is coupled to the output end of the power supply and the second end of the first transistor switch is coupled to the voltage-dividing end of the first voltage-dividing circuit; and a first regulator unit coupled to the first end of the first transistor switch and providing a first regulatory voltage for the first end of the first transistor switch; and a control unit arranged between the detection unit and the serial-parallel circuit, the control unit determining the first LED unit and the second LED unit to be set up in the serial connection or in the parallel connection according to the corresponding detection signal;

wherein the third end of the first transistor switch is coupled to the control unit and the voltage difference between the first regulatory voltage and the first division voltage turns on or off the first transistor switch and the third end of the first transistor switch generates the corresponding detection signal.

2. The light emitting diode driving circuit of claim 1, wherein the first regulatory unit further comprises a first Zener diode, an anode of the first Zener diode coupled to the ground voltage, a cathode of the first Zener diode coupled to the first end of the first transistor switch for providing the first regulatory voltage for the first end of the first transistor switch.

3. The light emitting diode driving circuit of claim 1, wherein:

the first switch circuit comprises a first end, a second end, and a third end, wherein the first end of the first switch circuit is coupled to the output end of the power supply, the second end of the first switch circuit is coupled to the control unit, and the third end of the first switch circuit is coupled to the first LED unit;

the second switch circuit comprises a first end, a second end, and a third end, wherein the first end of the second switch circuit is coupled to the second LED unit, the second end of the second switch circuit is coupled to the control unit, and the third end of the second switch circuit is coupled to the ground voltage; and the connecting circuit is coupled to the third end of the first switch circuit and the first end of the second switch circuit.

4. The light emitting diode driving circuit of claim 3, wherein the connecting circuit further comprises a diode, an anode of the diode connected to the first end of the second switch circuit and a cathode of the diode coupled to the third end of the first switch circuit.

5. The light emitting diode driving circuit of claim 3, wherein the control unit further comprises:

a first control circuit arranged between the third end of the first transistor switch and the first switch circuit; and a second control circuit arranged between the third end of the first transistor switch and the second switch circuit.

6. The light emitting diode driving circuit of claim 5, wherein the first control circuit further comprises:

a second voltage-dividing circuit comprising a first end, a second end, and a voltage-dividing end, the first end of the second voltage-dividing circuit coupled to the output end of the power supply, the second voltage-dividing circuit generating a second division voltage at the voltage-dividing end of the second voltage-dividing circuit for the second end of the first switch circuit according to the output voltage of the power supply; and a second transistor switch comprising a first end, a second end, and a third end, wherein the first end of the second transistor switch is coupled to the second end of the second voltage-dividing circuit, the second end of the second transistor switch is coupled to the third end of the first transistor switch, and the third end of the second transistor switch is coupled to the ground voltage.

7. The light emitting diode driving circuit of claim 6, wherein the second control circuit further comprises:

a third voltage-dividing circuit comprising a first end, a second end, and a voltage-dividing end;

a fourth voltage-dividing circuit comprising a first end, a second end, and a voltage-dividing end;

a third transistor switch comprising a first end, a second end, and a third end, wherein the first end of the third transistor switch is coupled to the second end of the third voltage-dividing circuit, the second end of the third transistor switch is coupled to the third end of the first transistor switch, and the third end of the third transistor switch is coupled to the ground voltage;

a fourth transistor switch comprising a first end, a second end, and a third end, wherein the first end of the fourth transistor switch is coupled to the second end of the second switch circuit, the second end of the fourth transistor switch is coupled to the voltage-dividing end of the third voltage-dividing circuit and the second end of the fourth voltage-dividing circuit;

a second regulator unit coupled to the first end of the third voltage-dividing circuit and the voltage-dividing end of the fourth voltage-dividing circuit and providing a second regulatory voltage for the first end of the third voltage-dividing circuit and the voltage-dividing end of the fourth voltage-dividing circuit.

8. The light emitting diode driving circuit of claim 7, wherein:

when the corresponding detection signal turns on the second transistor switch and the third transistor switch, the first switch circuit and the second switch circuit are turned on and the first LED unit and the second LED unit are in parallel connection; and when the corresponding detection signal turns off the second transistor switch and the third transistor switch, the first switch circuit and the second switch circuit are turned off and the first LED unit and the second LED unit are in serial connection.

9. The light emitting diode driving circuit of claim 7, wherein the second regulatory unit further comprises a second Zener diode, an anode of the second Zener diode coupled to the ground voltage, a cathode of the second Zener diode coupled to the first end of the third voltage-dividing circuit and the voltage-dividing end of the fourth voltage-dividing circuit.

* * * * *